US007021565B2

(12) United States Patent
Coldren et al.

(10) Patent No.: US 7,021,565 B2
(45) Date of Patent: Apr. 4, 2006

(54) PRESSURE MODULATED COMMON RAIL INJECTOR AND SYSTEM

(75) Inventors: Dana R. Coldren, Fairbury, IL (US); Richard R. Ohs, State College, PA (US); Scott F. Shafer, Morton, IL (US); Yongxin Wang, Bloomington, IL (US)

(73) Assignee: Caterpillar Inc., Peoria, IL (US)

( * ) Notice: Subject to any disclaimer, the term of this patent is extended or adjusted under 35 U.S.C. 154(b) by 195 days.

(21) Appl. No.: 10/775,591

(22) Filed: Feb. 10, 2004

(65) Prior Publication Data

US 2005/0173563 A1 Aug. 11, 2005

(51) Int. Cl.
*F02M 59/00* (2006.01)
*B05B 1/30* (2006.01)
*B05B 9/00* (2006.01)

(52) U.S. Cl. ..... 239/533.2; 239/88; 239/533.1; 239/124; 239/533.8; 239/585.1; 239/585.5; 239/5

(58) Field of Classification Search ..... 239/533.2, 239/533.1, 533.3, 533.8, 533.9, 533.12, 124, 239/585.1–585.5, 88–93, 5; 251/129.15, 251/129.21, 127
See application file for complete search history.

(56) References Cited

U.S. PATENT DOCUMENTS

| | | | | |
|---|---|---|---|---|
| 4,674,688 | A | 6/1987 | Kanesaka | |
| 5,397,055 | A * | 3/1995 | Paul et al. | 239/124 |
| 5,441,029 | A | 8/1995 | Hlousek | |
| 5,497,750 | A | 3/1996 | Mueller et al. | |
| 5,605,134 | A | 2/1997 | Martin | |
| 5,984,200 | A | 11/1999 | Augustin | |
| 6,199,533 | B1 * | 3/2001 | Morris et al. | 123/299 |
| 6,264,116 | B1 * | 7/2001 | Harcombe et al. | 239/124 |
| 6,367,453 | B1 | 4/2002 | Igashira et al. | |
| 6,422,211 | B1 | 7/2002 | Boecking | |
| 2002/0043569 | A1 | 4/2002 | Boecking | |
| 2002/0084347 | A1 | 7/2002 | Boecking | |
| 2004/0011331 | A1 | 1/2004 | Brocco | |

FOREIGN PATENT DOCUMENTS

EP 1 143 139 A1 10/2000

OTHER PUBLICATIONS

J.Hlousek, Robert Bosch AG; Electronically Controlled Fuel Injection Systems for Medium Speed Diesel Engines; pp. 1-13.

Scienlab Electronic Systems GMBH; Diesel Piezo-Injector Controller DICU200/20C4; Apr. 12, 2002; pp. 1-9.

(Continued)

*Primary Examiner*—Davis Hwu
(74) *Attorney, Agent, or Firm*—Liell & McNeil

(57) ABSTRACT

Common rail fuel injectors typically have difficulty in changing an injection rate during an injection event. Fuel injectors for this common rail fuel injection system include a multi-position admission valve. The admission valve is stoppable at a middle position to inject fuel at a low rate. The lower rate is accomplished by leaking some fuel to drain to reduce injection pressure. The admission valve is also stoppable at a fully open position to inject fuel at a high rate. Fuel injection events are ended, and the fuel injectors maintained between injection events, with the admission valve member in contact with a supply seat to close the high pressure supply passage. This strategy can be used in conjunction with a spring-biased needle valve member to expand fuel injector capabilities.

20 Claims, 5 Drawing Sheets

OTHER PUBLICATIONS

Mahr, Dr.-Ing Bernd, Durnholz, Dr.-Ing. Manfred, Polach, Dr.-Ing. Wilhelm. Grieshaber, Dipl.-Ing. Hermann, Bosch, Robert GMBH, Stuttgart, Heavy Duty Diesel Engines-The Potential of Injection Rate Shaping for Optimizing Emissions and Fuel Consumption, symposium, May 4 and 5, 2000, pp. 350-371, vol. 1: Day 1, 2000 The Austrian Association for Motor Vehicle Technology (OVK), and the Institute for Combustion Engines and Motor Vehicle Manufacturing of the Technical University Vienna, Austria.

* cited by examiner

E
P
H
0
T
80
81
82
83
84

50
1
0
T
90
91
92
93

Q
0
T
97
98

Q

PRESSURE MODULATED COMMON RAIL INJECTOR AND SYSTEM

TECHNICAL FIELD

The present invention relates generally to common rail fuel injection systems, and more particularly to a method of injecting fuel with a fuel injector equipped with a multi-position admission valve.

BACKGROUND

In one class of common rail fuel injection system, a plurality of fuel injectors are fluidly connected via separate branch passages to a common rail that contains fuel pressurized to injection levels. An electrical actuator attached to each of the fuel injectors controls the timing and duration of each injection event. In one alternative, these electrical actuators are operably coupled to a needle control valve that acts to apply or relieve fuel pressure on a closing hydraulic surface of a needle valve member. The needle valve member moves to open and close the nozzle outlets to permit fuel injection and end injection events, respectively. In this type of system, fuel at injection pressure levels is always present within the fuel injectors, and around their respective needle valve members. However, injection does not take place until pressure on the closing hydraulic surface of the needle is relieved. Depending upon the particular fuel injector, the needle control valve can be positioned on the high pressure side upstream from a needle control chamber or on the low pressure drain side leading away from the needle control chamber. The closing hydraulic surface of the needle valve member is exposed to fluid pressure in a needle control chamber. While many of these types of fuel injectors have performed well and provided additional control over injection timing and quantity, they sometimes actually tend to end injection events too abruptly, causing an increase in undesirable emissions, particularly smoke emissions. In other words, engineers have observed that these supposedly more sophisticated fuel injectors can sometimes, and at some conditions, produce more smoke emissions than their simpler counterparts that rely upon a fuel pressure drop and the action of a biasing spring to close the nozzle outlets to end an injection event. In addition, depending upon the location of the needle control valve, these fuel injectors can sometimes suffer from chronic leakage problems due at least in part to the fact that they are always pressurized, even between injection events.

In another common rail fuel injector strategy, an admission valve either opens a nozzle passage to a high pressure supply passage connected to the common fuel rail, during an injection event, or connects the nozzle passage to a low pressure drain passage between injection events. For instance, a Dutch Publication entitled, Common Rail Fuel Injection System For High Speed Large Diesel Engines, by Robert Bosch AG, © CIMAC Congress 1998 Copenhagen shows such a common rail fuel injector. It has a pilot operated three-way admission valve that fluidly connects the nozzle passage to either the high pressure supply passage or a low pressure drain passage. The nozzle passage is fluidly connected to the nozzle outlets when the needle valve member is lifted to its open position. The needle valve member in this injector appears to be a simple check valve, in that the needle valve member is biased towards a closed position with a pre-load on a biasing spring positioned in a vented chamber. Thus, the opening and closing of the nozzle outlets is controlled by fuel pressure in the nozzle passage that is acting against a simple biasing spring. Although the strategy presented by this fuel injector may have promise, it appears to suffer from several drawbacks, the least of which being the reliance upon a pilot operated admission valve. In other words, an electrical actuator is operably coupled to move with a pilot valve member. Depending upon the position of the pilot valve member, a control surface on a slave valve member is either exposed to low pressure or high pressure to move the same to a desired position. Because of the additional moving parts and close dynamic coupling between the pilot valve and the slave valve, there appears to be substantial likelihood of difficulty in mass producing fuel injectors of this type to reliably behave similar to one another, as would be necessary in order to gain the full potential benefits of a fuel injector design.

In addition, those skilled in the art will appreciate that rate shaping in common rail fuel injection systems is problematic.

The present invention is directed to one or more of the problems set forth above.

SUMMARY OF THE INVENTION

In one aspect, a fuel injector includes an injector body that includes a supply passage, a drain passage and a nozzle passage disposed therein. An admission valve includes a valve member that is trapped to move between a drain valve seat and supply valve seat. The valve member is stoppable at a middle position out of contact with both the drain and supply valve seats. The supply passage is fluidly connected to both the nozzle passage and the drain passage when the valve member is in its middle position. The nozzle passage is open to the drain passage but closed to the supply passage when the valve member is in a closed position in contact with the supply valve seat. The nozzle passage is open to the supply passage, but closed to the drain passage, when the valve member is in a fully open position in contact with the drain valve seat.

In another aspect, a method of injecting fuel includes a step of injecting fuel at a low rate at least in part by stopping an admission valve member at a middle position out of contact with a drain valve seat and a supply valve seat. Fuel is injected at a high rate at least in part by stopping the admission valve member in a fully open position in contact with the drain valve seat. Fuel injection is ended at least in part by stopping the admission valve member in a closed position in contact with supply valve seat.

In still another aspect, a fuel injection system includes a means for stopping an admission valve member in an injector body at a middle position out of contact with a drain seat and a supply seat to inject fuel at a low rate. The system also includes a means for stopping the admission valve member at a fully open position in contact with a drain seat to inject fuel at a high rate. Finally, the system includes means for stopping the admission valve member at a closed position in contact with the supply seat to end fuel injection.

DETAILED DESCRIPTION

Figure 1:
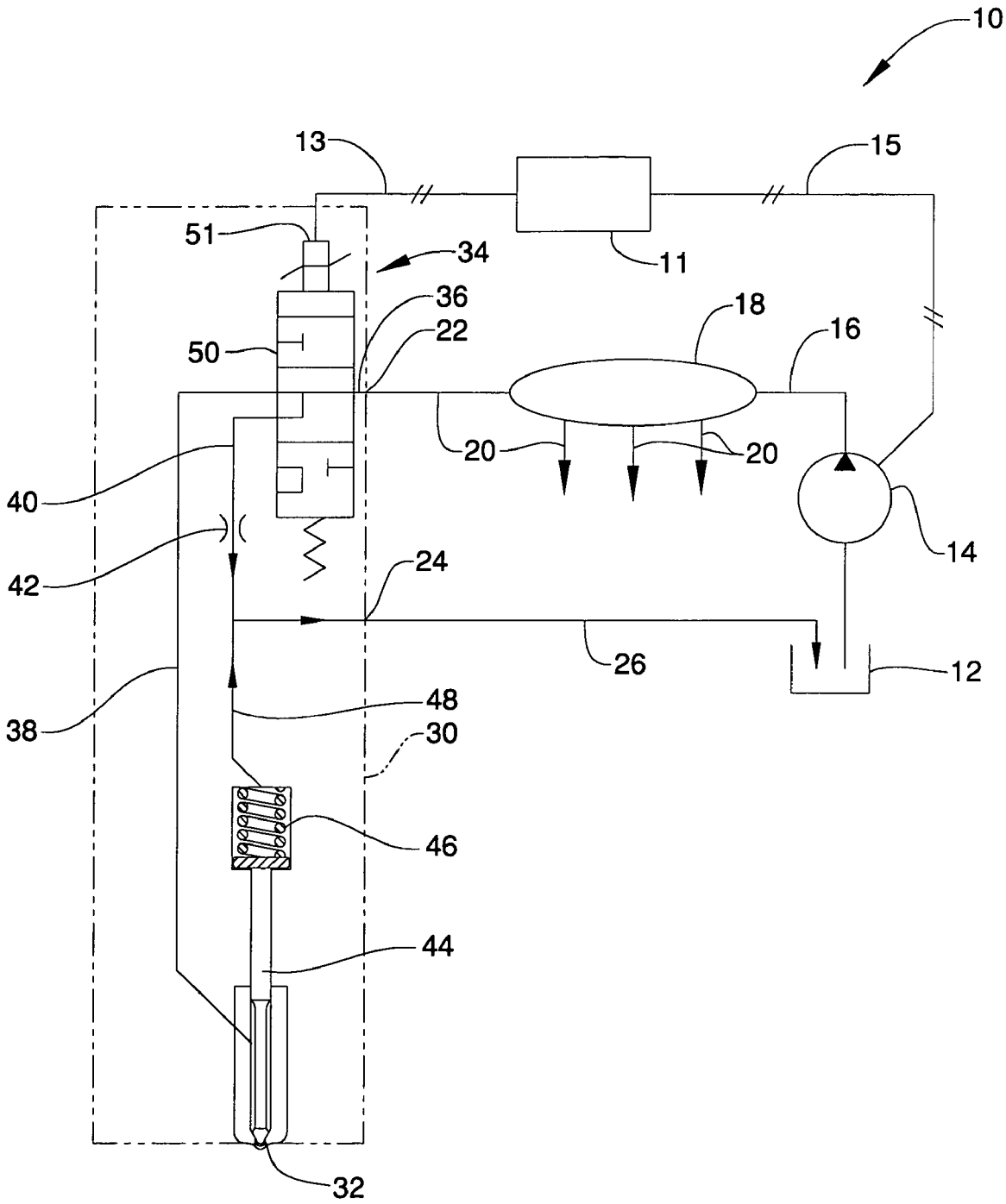
FIG. 1 is a schematic illustration of a fuel injection system according to the present invention.

Referring to FIG. 1, a fuel injection system (10) includes a common fuel rail (18) connected via separate branch passages (20) to a plurality of fuel injectors (30), only one of which is shown. Like many common rail systems, system (10) includes a high pressure pump (14) that draws low pressure fuel from a fuel tank (12) and delivers the same to the high pressure common rail (18) via a supply line (16). Each of the branch passages (20) from common rail (18) is fluidly connected to a fuel inlet (22) of an individual fuel injector (30). A fuel drain outlet (24) from each of the fuel injectors (30) is fluidly connected to tank (12) via a drain passage (26). In the preferred embodiment, fuel injection system (10) is used in conjunction with a compression ignition engine (not shown) such that the nozzle outlets of the individual fuel injectors (30) are positioned to inject fuel directly into the engine's cylinders.

Figure 2:
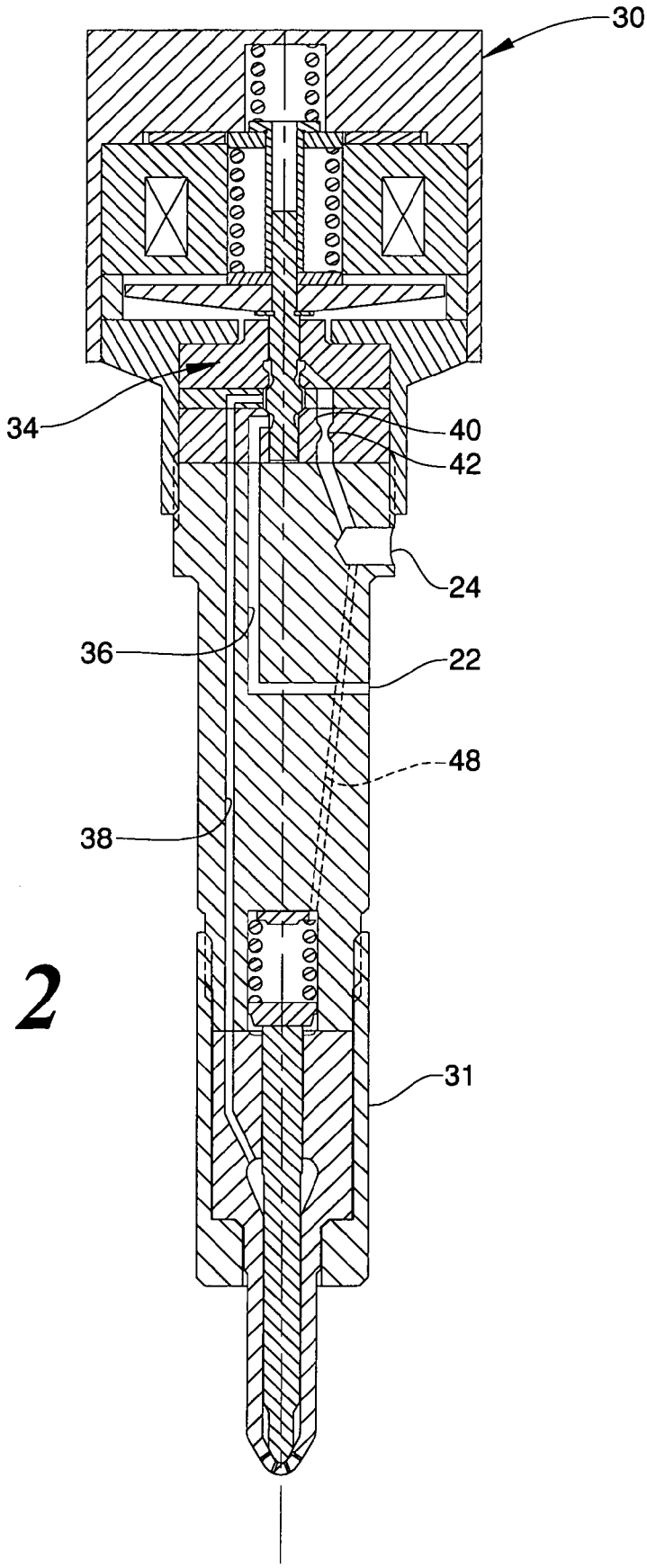
FIG. 2 is a sectioned side diagrammatic view of a fuel injector for the system of FIG. 1.
Figure 3:
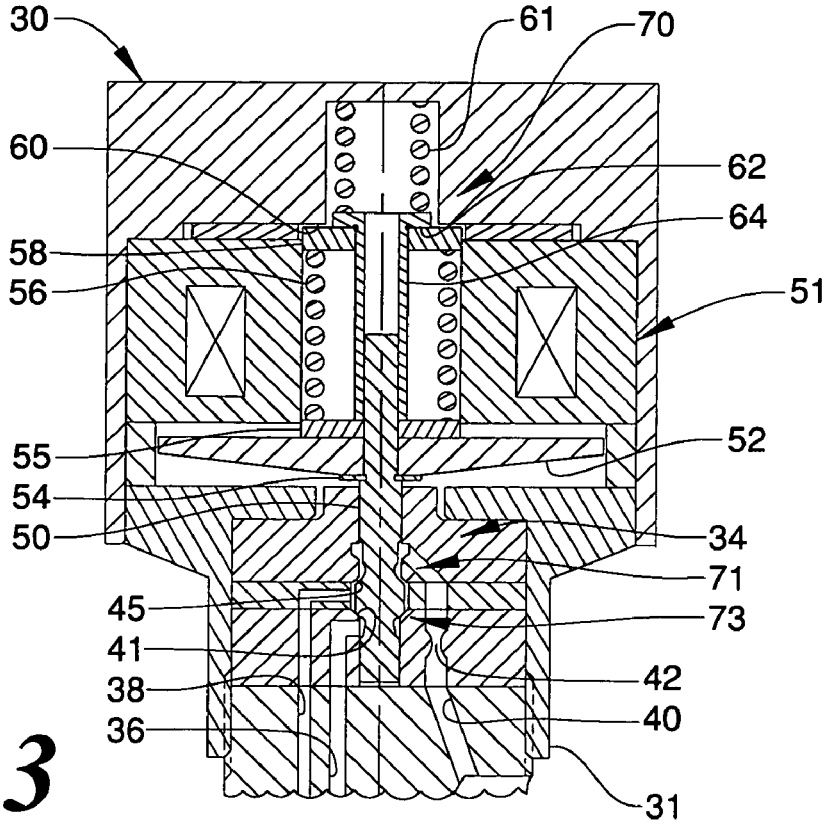
FIG. 3 is a partial sectioned side diagrammatic view of a control portion of the fuel injector of FIG. 2.

Referring now in addition to FIGS. 2 and 3, each fuel injector (30) includes an injector body (31) that defines a plurality of nozzle outlets (32). A conventional needle valve (44) that is biased closed via a biasing spring (46) controls the opening and closing of nozzle outlets (32). In other words, when fuel pressure in a nozzle passage (38) acting on an opening hydraulic surface of needle valve member (44) overcomes the biasing force of spring (46), needle valve member (44) lifts to an open position to fluidly connect nozzle passage (38) to nozzle outlets (32). In the preferred embodiment, biasing spring (46) is positioned in a vented cavity that is vented to low pressure drain passage (26) via a vent passage (48).

A multi-position admission valve (34) is attached to each injector body (31) and acts as the means by which nozzle passage (38) is fluidly connected to supply passage (36) and/or drain passage (40), which is fluidly connected to drain passage (26) via a flow restriction orifice (42). The flow orifice (42) is preferably restrictive to fluid flow relative to flow through admission valve (34). FIG. 1 shows the admission valve member (50) in a middle position in which supply passage (36) is simultaneously fluidly connected to nozzle passage (38) and drain passage (40). The position of admission valve member (50) is controlled by an electrical actuator (51), which may be powered by an electronic control module (11) in a conventional manner via a communication line (13). Electronic control module (11) may also control fuel pressure in rail (18), such as via controlling pump (14)'s output via a communication line (15).

Referring specifically to FIG. 3, in the preferred embodiment, admission valve (34) includes an admission valve member (50) that is trapped to move between a supply seat (41) and a drain seat (45). Nozzle passage (38) opens into the area adjacent to valve member (50) that is between seats (41) and (45). In this embodiment, electrical actuator (51) includes a solenoid with an armature (52) that is attached to move with admission valve member (50). In one example attachment structure, a washer (54) is supported on a ledge on admission valve member (50) and acts as a platform upon which armature (52) can rest. Above armature (52), a pre-load spacer (55) is included, and may constitute a category part of varying thicknesses to adjust the pre-load of first biasing spring (56). The other end of biasing spring (56) bears against a stop spacer (58). It is held in place via a contact surface (62) on a nut (64) that is attached to one end of admission valve member (50) and in contact with a top surface of pre-load spacer (55). A second biasing spring (61) is compressed between the injector body and the top of nut (64). When the solenoid is de-energized, springs (56) and (61) bias armature (52) and valve member (50) downward into contact with supply seat (41). When armature (52) and valve member (50) are in this position, stop spacer (58) is out of contact with middle stop surface (60) on injector body (31).

When a solenoid is energized, and both armature (52) and valve member (50) begin moving upwards, before valve member (50) comes in contact with drain seat (45), stop spacer (58) will come in contact with middle stop surface (60). Thus, over the first portion of the valve member's travel between supply seat (41) and stop surface (60), only biasing spring (61) acts in opposition to the solenoid force. This is also accomplished by setting the pre-load on biasing spring (56) substantially higher than that of spring (61). Thus, when the solenoid is appropriately energized, an equilibrium position will exist where stop spacer (58) is in contact with stop surface (60), and valve member (50) will be out of contact with both supply seat (41) and drain seat (45). In this middle position, supply passage (36) is fluidly connected both to nozzle passage (38) and drain passage (40). When the solenoid is further energized, the higher attractive force pulls armature (52) and valve member (50) further upwards compressing biasing spring (56) and (61) until valve member (50) comes in contact with drain seat (45) at its fully open position. Thus, in this illustrated embodiment, the various structures described constitute a means (73) for stopping the valve member at a closed position in contact with supply seat (41). In addition, the various components, especially the dual spring design, constitutes portions of a means (70) for stopping the valve member (50) at a middle position. Finally, the various components described including the electrical actuator (51) comprise a means (71) for stopping the valve member (50) at a fully open position in contact with drain seat (45).

The orifice (42) that presents a flow restriction in drain passage (40) is present for a number of reasons. Among these reasons is to preferably create a flow restriction relative to a flow area past drain seat (45) when valve member (50) is in its middle position. This aspect of the invention helps to desensitize injector performance to inevitable variations in flow areas past drain seat (45) among a plurality of fuel injectors. Nevertheless, the present invention could be constructed in a way such that the flow area past drain seat (45) could be tightly controlled through known geometrical tolerance techniques and allow for the elimination of orifice (42). However, by including orifice (42), one can control the flow area that directly connects the high pressure supply passage (36) to the drain passage (40) such that pressure in nozzle passage (38) can be indirectly selected as a function of rail pressure and orifice diameter when valve member (50) is at its middle position to inject fuel at a low pressure. When the valve member (50) is in its fully open position in contact with drain seat (45), orifice (42) is substantially out of play and high pressure supply passage (36) is fluidly connected only to nozzle passage (38) to inject fuel at a high pressure.

Figure 4:
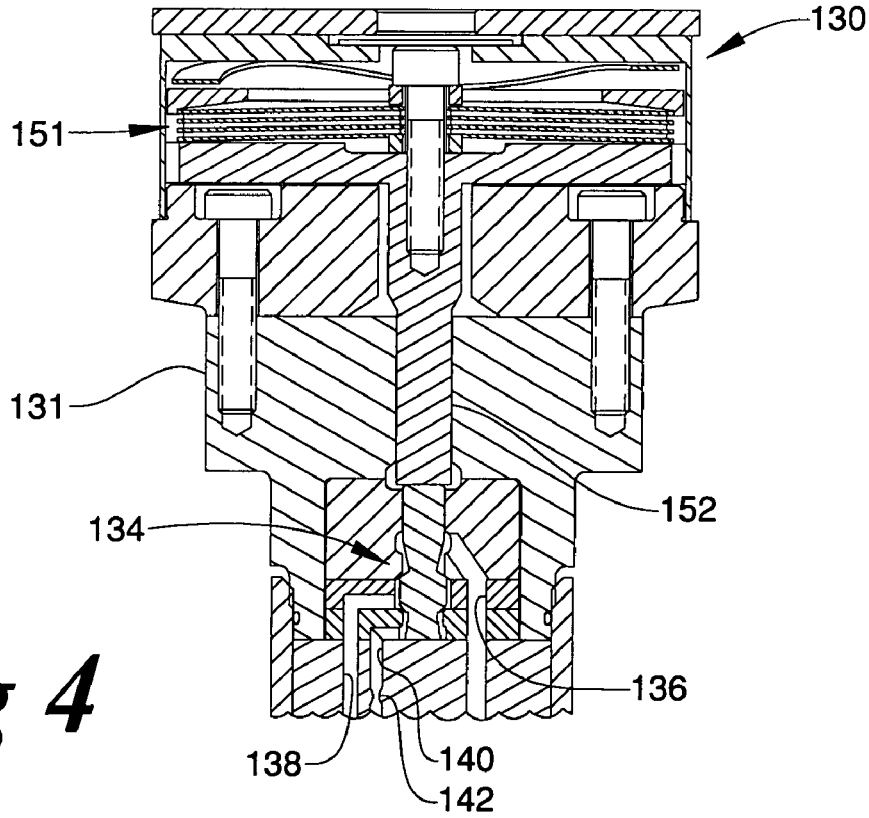
FIG. 4 is a partial sectioned side diagrammatic view of the control portion of a fuel injector according to another aspect of the present invention.

Referring now to FIG. 4, an alternative embodiment of the present invention includes a fuel injector (130) with an injector body (131) and an admission valve (134) that is similar to the admission valve (34) discussed earlier except that the location of high pressure supply passage (136) and low pressure drain passage (140) have been reversed. Like the earlier embodiment, the nozzle passage (138) fluidly opens adjacent the valve member between the drain and supply seats. Also like the previous embodiment, a flow restriction orifice (142) is preferably suitably positioned in drain passage (140). This embodiment differs from the earlier embodiment in that electrical actuator (151) is illustrated as a piezo bender actuator whose position can be controlled to allow the valve member to stop in a plurality of middle positions out of contact with both the drain seat and the supply seat. Those skilled in the art will appreciate that, depending upon the voltage applied to the piezo, it will deflect in proportion to that voltage. Although this embodiment has been illustrated with a piezo bender actuator, other piezo actuators, such as a stack, could be substituted. Thus, with a feedback means, such as the inclusion of a position sensor or by detecting engine rpm changes, the actuation of piezo bender (151) could be tuned to tightly control the positioning of the valve member between the drain and supply seats. The piezo bender actuator version of the present invention may provide a better candidate for the elimination of restriction orifice (142) and possibly provide for the ability to tune the injector to inject fuel at a plurality of different middle range pressures by appropriately positioning the valve member to restrict flow to drain passage (40) when the valve member is in one of its middle positions. The piezo bender actuator (151) of the FIG. 4 embodiment moves the valve member via a movable member (152). In the structure illustrated, the valve member would be biased up into contact with movable member (152) with a suitable biaser, such as a spring (not shown). In an alternative, the valve member could be attached to movable member (152) and the valve could be biased upward to close high pressure supply passage (136) via a pre-stress in the piezo bender actuator. Thus, in the alternative of FIG. 4, the biasing springs of the FIG. 3 embodiment could potentially be eliminated with reliance upon a selected pre-stressing of the actuator and attachment to the valve member.

INDUSTRIAL APPLICABILITY

Figures 5A, 5B, 5C:
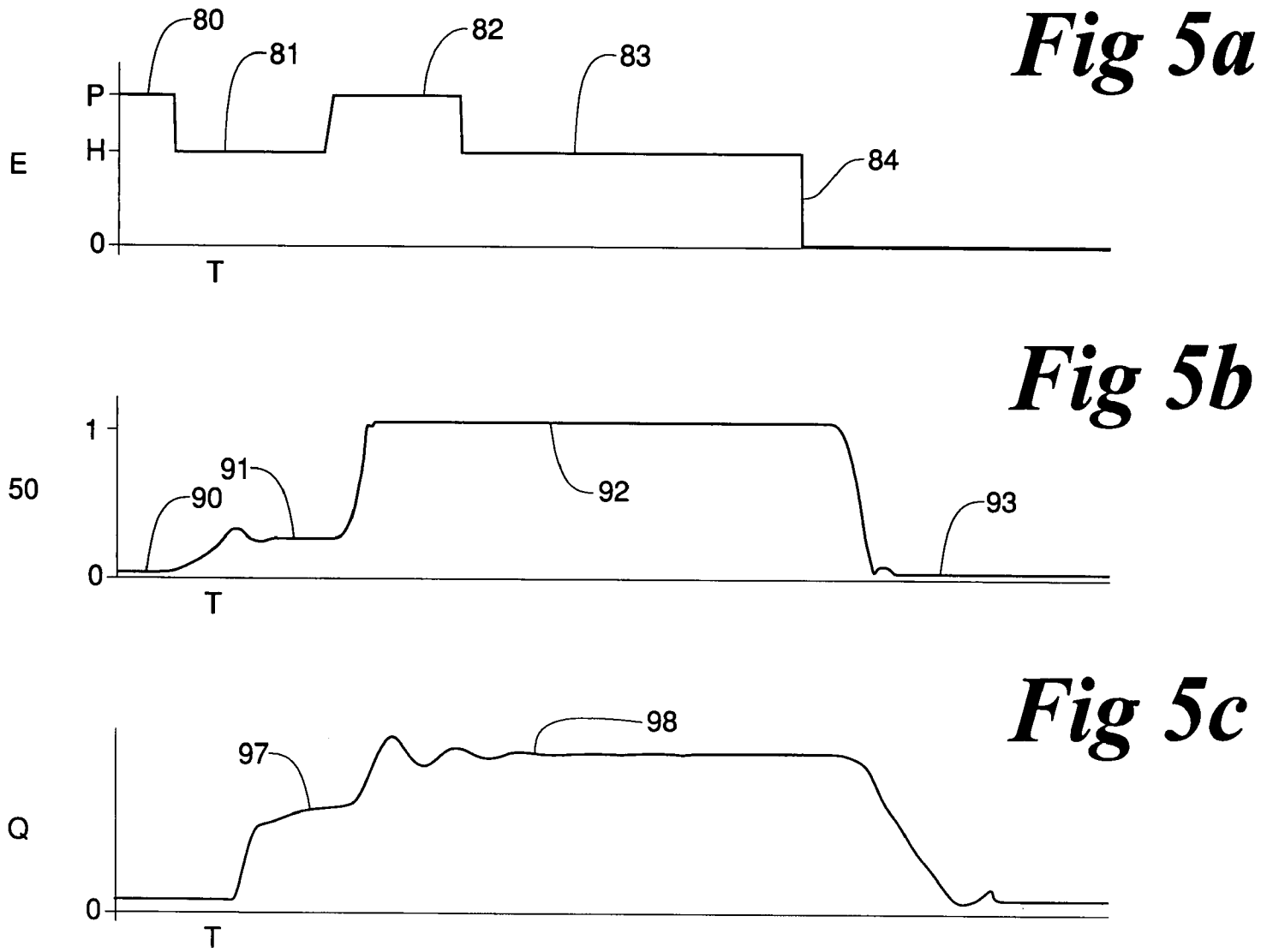
FIGS. 5*a*–5*c* are graphs of control signal, valve position and injection rate verses time, respectively, according to an aspect of the present invention.

Referring now to FIGS. 5*a–c*, an example injection event according to the present invention is illustrated. Between injection events, the electrical actuator is preferably de-energized, and the high pressure supply passage (36, 136) is closed, such that fuel pressure in nozzle passage (38) remains low. FIG. 5*a* shows, at time zero, the initiation of an injection event by first applying a pull-in current (80) to the electrical actuator (51). Before the force from the solenoid is realized, the admission valve member (50) is in its closed position (90) closing the high pressure supply passage (36), see FIG. 5*b*. After some brief delay, the admission valve member (50) begins to move, and about that time the current level to the solenoid is dropped to a hold-in current level (81). This results in the valve member stopping in a middle position (91) with stop spacer (58) in contact with stop surface (60) such that valve member (50) stops in the middle position (91) out of contact with both drain seat (45) and supply seat (41). By appropriately sizing the orifice (42), sufficient pressure exists in nozzle passage (38) to overcome the biasing spring (46) such that needle valve member (44) lifts to an open position to commence the spray fuel at a low injection rate (97) as shown in FIG. 5*c*. After another delay, the current level to the actuator is again raised to a pull-in current level (82), which causes the valve member (50) to lift further up to its fully open position (92) in contact with drain seat (45). After some brief delay, current is dropped to a hold in level 83. When this occurs, fuel commences injecting at a high injection rate (98). After some duration, when it is time to end the injection event, current to the electrical actuator is ended (84). When this occurs, after a short delay, the valve member (50) moves from its fully open position back to its closed position (93) to end the injection event. As valve member (50) moves to close supply passage (36), fuel pressure in a fuel injector begins to decay until the valve closing pressure is reached and the needle valve member (44) moves downward to close nozzle outlets (32) under the action of biasing spring (46).

The present invention allows for the injection of fuel at a relatively low rate by stopping the valve member at a middle position, and allows for injection of fuel at a high rate by stopping the valve member at a fully open position. Those skilled in the art will appreciate that the two injection rates can be accomplished in a single injection event or in separate injection events. For instance, the fuel injector of the present invention could inject a small pilot injection at a low injection rate and follow that with a main injection at a high rate and then follow that main injection event with a post injection event at a low or high rate. Those skilled in the art will appreciate that the FIG. 4 embodiment that includes a piezo bender actuator could potentially have substantially more capabilities than the solenoid version of the present invention. In particular, the piezo bender version of the invention could conceivably allow for an injection rate to be directly proportional to the voltage applied to the piezo bender. In other words, by varying the voltage to the piezo bender, the flow area to the drain could be varied to in turn vary pressure in the nozzle passage to inject fuel over a continuum of different pressures that would lie between the valve opening pressure of the needle valve member and the rail pressure when the valve member is in its fully open position.

Figure 6A:
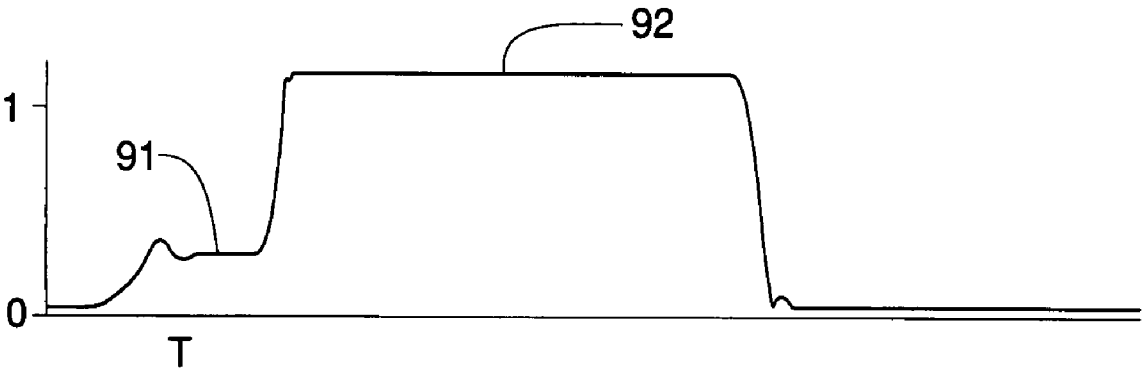
FIGS. 6*a*–*b* are graphs of valve position and injection rate according to another aspect of the present invention.
Figure 6B:
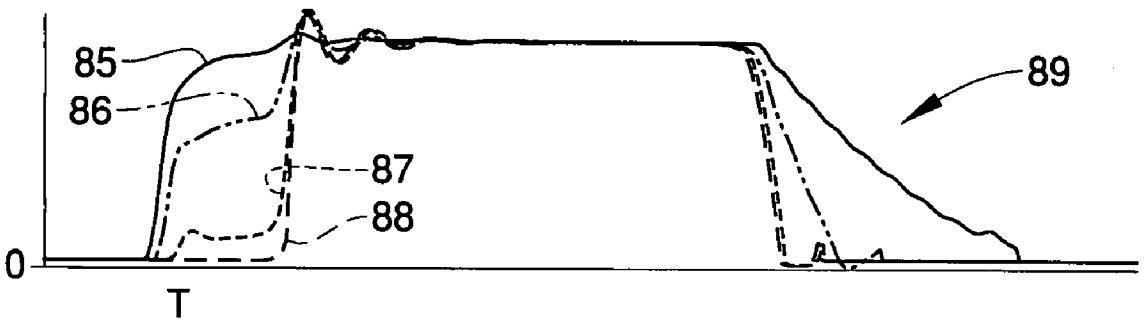

Referring now to FIGS. 6*a* and 6*b*, several example drain orifice sizes are compared to demonstrate the effect of drain orifice size on the ability, and pressure at which an injection event at a lower pressure takes place. FIG. 6*a* shows that at the beginning portion the valve member is stopped at its middle position (91) and then later moved to its fully open position (92) for the remainder of the injection event. The curve (85) shows the result when the injector has no drain at all. In this example, the initial injection rate when the valve member is at its middle position is about the same as the injection rate when the valve is in its fully open position, because there is no loss of pressure to a drain. This lack of a drain also reveals itself at the end of injection by a relatively slow end to the injection event caused by the relatively slower decay in the fuel pressure, which can only decay through the nozzle outlets. The curve (86) shows an example when the drain orifice has about a 0.5 mm diameter such that the low injection rate is a little bit more than half the maximum injection rate. The relatively small diameter 0.5 mm orifice also reveals itself at the end of injection by resulting in a less than abrupt end to injection due to the additional time necessary to decay fuel pressure both through the orifice and out the injector outlets toward the end of the injection event. In still another example, the curve (87) shows the same injection rate trace when the drain orifice is set at 1.0 mm such that the injection at a low rate is about ten to twenty percent that of the injection rate when the valve member is in its fully open position. This alternative results in a relatively abrupt end to injection. The curve (88) shows when the drain orifice is relatively large, or in the illustrated embodiment about 1.5 mm. This implicitly shows that in the illustrated embodiment a drain orifice having a diameter of 1.5 mm is sufficiently large that pressure in the nozzle passage (38) does not reach valve opening pressure when the valve member is in its middle position such that no injection takes place at the middle position and the injector merely leaks fuel back to tank via the drain passage until the valve member is lifted to its fully open position where the injection event looks much like that of the other examples.

Depending upon the alternative chosen, the present invention can provide substantial advantages over prior art fuel injection systems. Firstly, because the control is gained through an admission valve, chronic leakage problems associated with prior art fuel injectors can be reduced and possibly eliminated. In addition, by having the admission valve member directly moved by an electrical actuator, the complications and uncertainties associated with pilot operation can also be avoided. Finally, by utilizing a drain orifice with a flow restriction relative to flow through the valve, the performance of the fuel injector can be desensitized to inevitable small variations in the flow areas through the valve due to such things as ordinary geometrical tolerances employed to manufacture the valve. By carefully controlling the signal to the electrical actuator, those skilled in the are will appreciate that the fuel injector of the present invention can exhibit the ability to produce front end rate shapes that include square front end, a ramp front end, a boot shaped front end and others. In addition, because the fuel injector employs a conventional spring bias needle and relies upon pressure decay to close the nozzle outlets at the end of an injection event, smoke emissions levels can predictably be reduced over counterpart common rail injectors that rely upon direct control needles to end injection events arguably too abruptly when pressure is still high. This fuel injector also has the advantage over drain mounted direct control common rail injectors in that leakage to tank occurs intentionally only when injecting at a low rate, which is likely to be for very short durations in the overall scheme of things. The piezo bender version of the present invention can potentially provide even more performance advantages in that with a suitable feedback strategy of a type known in the art, the injector could be tuned to inject fuel at a plurality, and possibly a continuum of different rates, depending upon the magnitude of electrical energy being supplied to the actuator at any given time.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. A fuel injector comprising:

an injector body defining a supply passage, a drain passage and a nozzle passage;

an admission valve that includes a valve member trapped to move between a drain valve seat and a supply valve seat;

said valve member being stoppable at a middle position out of contact with said drain and supply valve seats;

said supply passage being fluidly connected to both said nozzle passage and said drain passage when said valve member is in said middle position;

said nozzle passage being open to said drain passage but closed to said supply passage, when said valve member is in a closed position in contact with said supply valve seat; and said nozzle passage being open to said supply passage, but closed to said drain passage, when said valve member is in a fully open position in contact with said drain valve seat.

2. The fuel injector of claim 1 including an electrical actuator attached to said injector body and including a movable portion; and said valve member is operably coupled to move with said movable portion.

3. The fuel injector of claim 2 wherein said electrical actuator includes one of a solenoid and a piezo electric actuator.

4. The fuel injector of claim 1 wherein said drain passage includes an orifice with a flow area that is restrictive relative to a flow area across said drain valve seat when said valve member is in said middle position.

5. The fuel injector of claim 4 wherein said orifice has a circular cross-section with a diameter less than or equal to 1.5 mm.

6. The fuel injector of claim 1 wherein said injector body includes a plurality of nozzle outlets with a combined flow area that is restrictive relative to a flow area across said drain valve seat when said valve member is in said middle position.

7. The fuel injector of claim 1 including a first spring operably coupled to bias said valve member toward said closed position;

a second spring operably coupled to bias said valve member toward said closed position only when said valve member is between said middle position and said fully open position, and being inoperable to bias said valve member when said valve member is between said closed position and said middle position.

8. The fuel injector of claim 7 wherein said drain passage includes an orifice with a flow area that is restrictive relative to a flow area across said drain valve seat when said valve member is in said middle position;

an electrical actuator, which includes one of a solenoid and a piezo electric actuator, attached to said injector body and including a movable portion; and said valve member is operably coupled to move with said movable portion.

9. A fuel injection system comprising:

a common fuel rail; and a plurality of fuel injectors according to claim 1 fluidly connected to said common fuel rail.

10. A method of injecting fuel, comprising the steps of:

injecting fuel at a low rate at least in part by stopping an admission valve member at a middle position out of contact with a drain valve seat and a supply valve seat;

injecting fuel at a high rate at least in part by stopping the admission valve member in a fully open position in contact with the drain valve seat; and ending fuel injection at least in part by stopping the admission valve member in a closed position in contact with the supply valve seat.

11. The method of claim 10 wherein the step of injecting fuel at low rate includes a step of fluidly connecting a supply passage to both a drain and a nozzle passage.

12. The method of claim 10 wherein said injecting steps include the step of opening fuel flow from a fuel common rail to a fuel injector.

13. The method of claim 10 wherein the step of injecting fuel at a low rate includes a step of supplying low electrical energy to an electrical actuator; and the step of injecting fuel at a low rate includes a step of supplying a high electrical energy to the electrical actuator.

14. The method of claim 10 including a step of coupling an admission valve member to move with a movable portion of an electrical actuator.

15. The method of claim 10 wherein the step of injecting fuel at a low rate includes restricting fuel flow in a drain passage downstream from a drain seat.

16. The method of claim 10 wherein the step of injecting fuel at a low rate includes a step of compressing one of a first biasing spring and a second biasing spring; and the step of injecting fuel at a high rate includes a step of compressing both of the first and second biasing spring.

17. A fuel injection system comprising:

means for stopping an admission valve member in an injector body at a middle position out of contact with a drain seat and a supply seat to inject fuel at a low rate;

means for stopping the admission valve member at a fully open position in contact with a drain seat to inject fuel at a high rate;

means for stopping the admission valve member at a closed position in contact with a supply seat to end fuel injection.

18. The fuel injection system of claim 17 wherein said injector body includes an orifice in a drain passage that is restrictive relative to a flow area between said admission valve member and said drain seat when said admission valve member is in said middle position.

19. The fuel injection system of claim 18 including an electrical actuator, which includes one of a solenoid and a piezo electric actuator, with a movable portion; and said admission valve member being operably coupled to move with said movable portion.

20. The fuel injection system of claim 19 including a common fuel rail fluidly connected to said injector body.

* * * * *